US005730576A

United States Patent [19]

O'Daniel

[11] Patent Number: 5,730,576

[45] Date of Patent: Mar. 24, 1998

[54] LIFTING AND DUMPING APPARATUS

[75] Inventor: Harold W. O'Daniel, 814 Muirfield, Mansfield, Tex. 76063

[73] Assignee: Harold W. O'Daniel, Mansfield, Tex.

[21] Appl. No.: 598,689

[22] Filed: Feb. 8, 1996

(Under 37 CFR 1.47)

[51] Int. Cl.[6] ..... B66F 9/06

[52] U.S. Cl. ..... 414/421; 414/607; 414/620; 414/641

[58] Field of Search ..... 414/420, 421, 414/607, 620, 639, 640, 641

[56] References Cited

U.S. PATENT DOCUMENTS

| | | | |
|---|---|---|---|
| 3,039,631 | 6/1962 | Baker | 414/640 X |
| 3,876,100 | 4/1975 | Bradi et al. | 414/620 |
| 4,095,708 | 6/1978 | Gerhard | 414/420 |
| 4,243,355 | 1/1981 | Brudi et al. | 414/620 |
| 4,540,330 | 9/1985 | Taylor | 414/641 |
| 4,580,940 | 4/1986 | Sheaves | 414/421 X |
| 4,921,389 | 5/1990 | O'Daniel | 414/420 |
| 5,024,573 | 6/1991 | Redding et al. | 414/421 X |

FOREIGN PATENT DOCUMENTS

| | | | |
|---|---|---|---|
| 2122401 | 11/1972 | Germany | 414/420 |
| 1057391 | 11/1983 | U.S.S.R. | 414/420 |
| 1569263 | 6/1990 | U.S.S.R. | 414/420 |

OTHER PUBLICATIONS

G&H Manufacturing, Inc. brochure "Model 8000 Series Container Carrier", 1990.

*Primary Examiner*—James W. Keenan
*Attorney, Agent, or Firm*—Charles D. Gunter, Jr.

[57] ABSTRACT

A lifting and dumping apparatus is shown for dumping the contents of a refuse container. A fixed frame is connected to a lifting attachment for moving the fixed frame between a rest position and an elevated position. A support frame is rotatably mounted on the fixed frame and has a pair of fork arms for engaging the refuse container. A rotator arm and actuator piston mechanism rotates the support frame, and hence the refuse container, between a horizontal position and a dumping position.

6 Claims, 3 Drawing Sheets

LIFTING AND DUMPING APPARATUS

BACKGROUND OF THE INVENTION

1. Field of the Invention

The present invention relates generally to lifting and dumping devices for dumping the contents of a container and, specifically, to such a device for dumping the contents of a refuse container.

2. Description of the Prior Art

A variety of forklift type devices are known in the prior art for lifting refuse and recycling type containers. These refuse and recycling containers, referred to collectively herein as "refuse" containers, are typically steel boxes with or without tops which have longitudinally extending side channels which are adapted to be engaged by the fork arms of a lifting device. The containers are lifted from, e.g., a site adjacent a retail store, for loading onto a truck and for transport to a dump or recycling location.

The prior art devices of the above type used for lifting refuse and recycling containers have included forklifts or lifting type devices with forklift arms for engaging the container longitudinal channels. The lifting device would lift the container vertically from the ground from a conveyance device, such as a truck. One advance in the art was the "Model 8000 Series Container Carrier" marketed by G&H Manufacturing, Inc. of Arlington, Tex. This container carrier was truck mounted and included a lifting apparatus for stacking 2 to 10 yard containers having front, rear and side loader boxes easily and quickly. The lifting apparatus had an 8000 pound lift capacity and the unit was offered with a rotator option which was capable of rotating a 6000 pound load approximately 180° between a dump and level position.

The prior design is described in U.S. Pat. No. 4,921,389, issued May 1, 1990, and featured a piston actuated chain drive which rotated the support frame for the container, and hence the refuse container, between the horizontal and dumping positions. In addition to the double ended piston and chain drive, the rotating mechanism for the device included a central sprocket mounted to a support frame which extended through a central sprocket opening of the fixed frame and a bearing race assembly carried between the vertical side walls of the fixed and support frames.

Despite the advantages offered by the improved apparatus, a need existed for a stronger and lighter weight device to accomplish the above tasks. A need also existed for a lifting and dumping apparatus having an improved rotator mechanism.

It is accordingly an object of the present invention to provide an improved lifting and dumping apparatus for lifting and dumping the contents of a refuse container by rotating the container once the container has been lifted.

Another object of the invention is to provide such an apparatus which is easily adapted to be mounted on the chassis of a truck.

Another object of the invention is to provide such an apparatus which is simple in design and economical to manufacture and which is extremely safe and reliable in operation.

Another object of the invention is to provide such a lifting and dumping apparatus having a stronger rotating mechanism than was previously available to allow the lifting and dumping of heavier loads.

SUMMARY OF THE INVENTION

The lifting and dumping apparatus of the invention is used to dump a refuse container of the type having a pair of longitudinally extending side channels. The lifting and dumping apparatus includes a fixed frame which is connected to a lifting attachment for moving the fixed frame between a rest position and a vertically elevated position. A support frame is rotatably mounted on the fixed frame and includes a pair of fork arms for engaging the container side channels. A piston actuated rotator assembly, independent of the lifting attachment, rotates the support frame, and hence the refuse container, approximately 180° through a selected range of angular rotation between a horizontal position and a dumping position at any of a plurality of selected vertically elevated positions of the lifting attachment. The piston actuated rotator assembly includes a plurality of rotator pistons, each of which is capable of rotating the support frame through a discrete portion of the selected range of angular rotation. The support frame is rotatably mounted on the fixed frame by means of a bearing axle assembly which is mounted on the fixed frame.

Preferably, the piston actuated rotator assembly includes a rotator arm connected to the support frame, a secondary rotator piston connected between the support frame and the rotator arm and a primary rotator piston connected between the rotator arm and the fixed frame for moving the refuse container between the horizontal and dumping positions. The fixed frame is preferably provided having a vertical wall portion with an exterior surface and an interior surface. The vertical wall portion is provided with an axle bearing assembly including a rotatable shaft which extends between the vertical wall exterior surface and the support frame. The support frame has a top, bottom and opposing sides which enclose a support plate. The shaft of the axle bearing assembly extends outwardly from the vertical wall portion generally normal thereto and is fixedly mounted to the support plate leaving an exposed length of the shaft between the vertical wall portion of the fixed frame and the support plate of the support frame. A rotator arm is attached to the exposed length of the rotatable shaft at one extent thereof. The primary rotator piston is attached to the rotator arm at proximate point adjacent the rotatable shaft at one extent thereof and the secondary rotator piston is attached to the rotator arm at a distant point at an opposite extent thereof. The primary and secondary rotator pistons are both arranged in a common plane which defines a spaced-apart opening between the exterior surface of the vertical wall portion of the fixed frame and the support plate of the support frame.

The lifting and dumping apparatus is used by first engaging the refuse container side channels with the fork arms of the support frame. The lifting attachment is then actuated to lift the refuse container a selected distance from the surrounding support surface. The piston actuated rotator assembly is then actuated to rotate the support frame, and hence the refuse container, through a selected range of angular rotation in order to dump the container.

Additional objects, features and advantages will be apparent in the written description which follows.

BRIEF DESCRIPTION OF THE DRAWINGS

in FIG. 1.

DETAILED DESCRIPTION OF THE INVENTION

Figure 1:
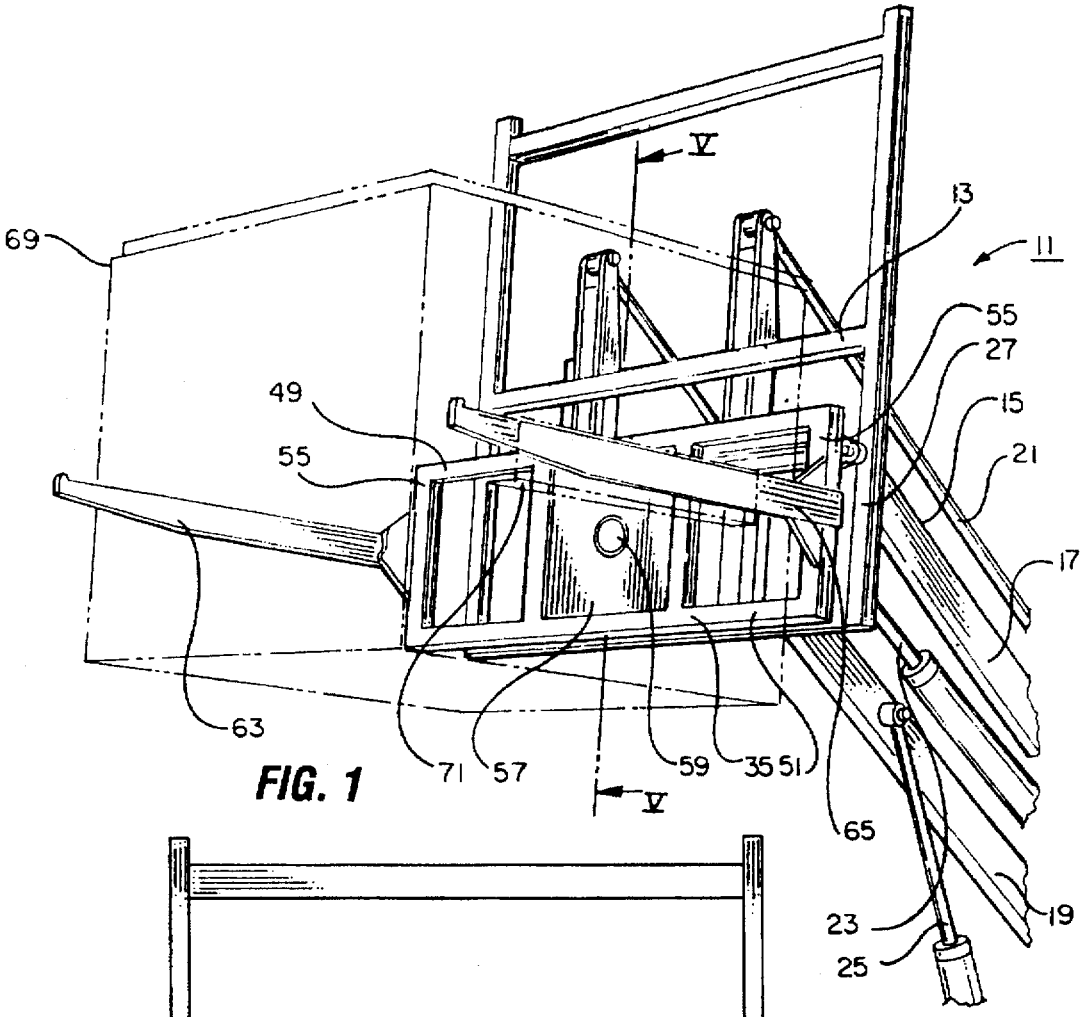
FIG. 1 is a perspective view of the lifting and dumping apparatus of the invention shown engaging the longitudinally extending channels of a refuse container, the container being shown in phantom lines.

FIG. 1 shows the lifting and dumping apparatus of the invention designated generally as 11. The apparatus 11 includes a fixed frame 13 which is connected to a lifting attachment 15. The lifting attachment 15 includes upper and lower lifting arms 17, 19 and a plurality of lifting pistons having piston rods 21, 23, 25. The piston rods 21, 23, 25 and associated lift pistons are hydraulically actuated for moving the fixed frame 13 between a rest position and a vertically elevated position, as shown in FIG. 1.

The lifting attachment 15 has an opposite end (not shown) which bolts to the chassis of a standard truck by means of U-bolts. The lifting attachment 15 is commercially available as the Model 8000 Container Carrier from G&H Manufacturing, Inc., 1018 North Commercial Boulevard, Arlington, Tex.

Figure 5:
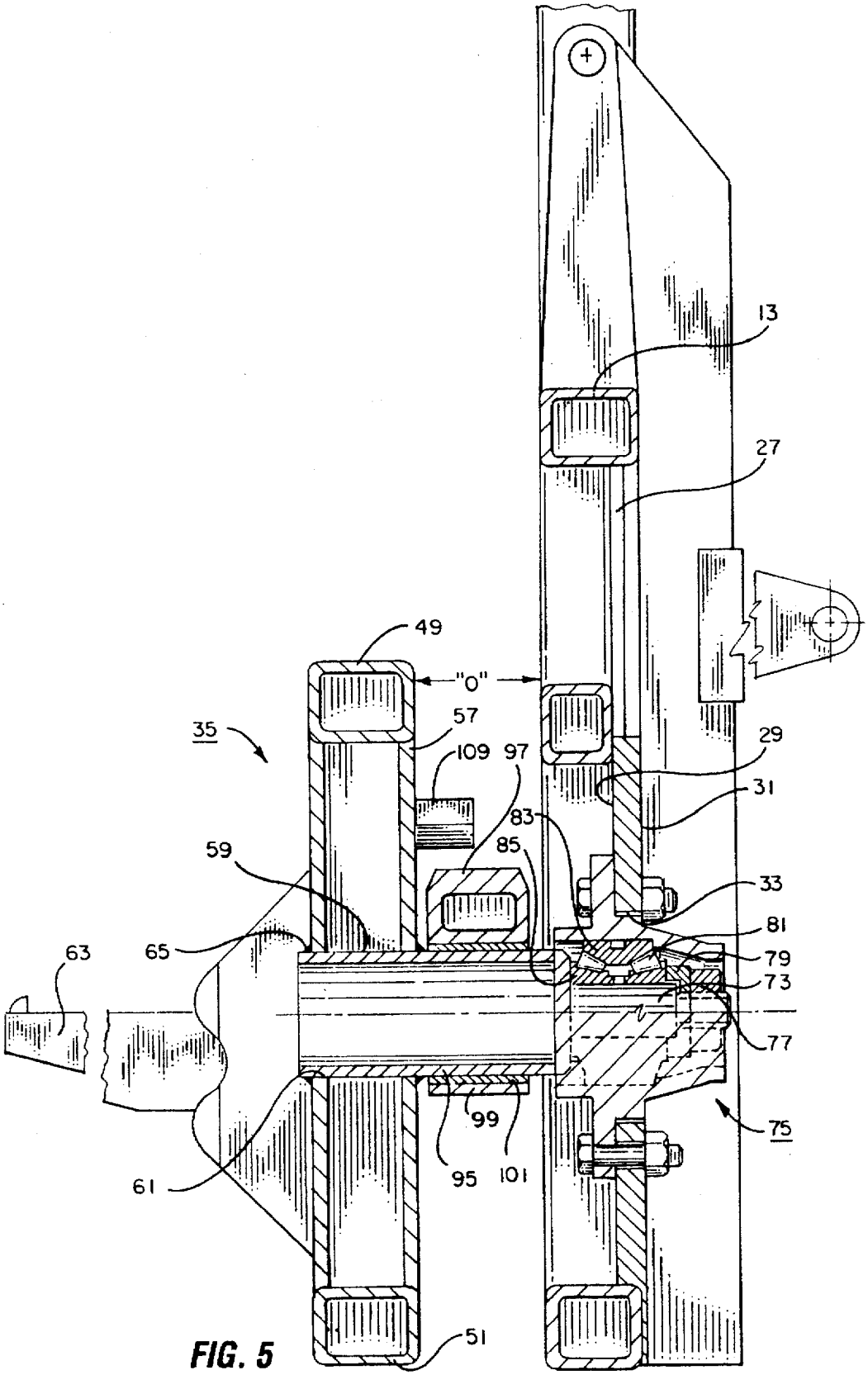
FIG. 5 is a side, cross-sectional view taken along lines V.—V.

As shown in FIGS. 1 and 5, the fixed frame 13 has a vertical wall portion 27 with an exterior surface 29 and an interior surface 31. The vertical wall portion 27 is provided with a central opening 33. A support frame 35 is rotatably mounted on the fixed frame. The support frame 35 has a top 49, a bottom 51 and opposing sides 53, 55 (FIG. 1). The frame top, bottom and opposing sides enclose a support plate 57. A rotator shaft (59 in FIG. 5) extends between the vertical wall exterior surface 29 and the support plate 57 of the support frame. The shaft 59 passes through a centrally located opening 61 in the support frame 35 and is fixedly mounted therein by means of weldments 63. The support frame 35 also has a pair of spaced-apart fork arms (63, 65 in FIG. 1) which extend outwardly, perpendicular to the support frame for engaging the longitudinal channels of the refuse container. FIG. 1 shows a typical container 69 with the channels 71 shown in phantom lines.

Figure 2:
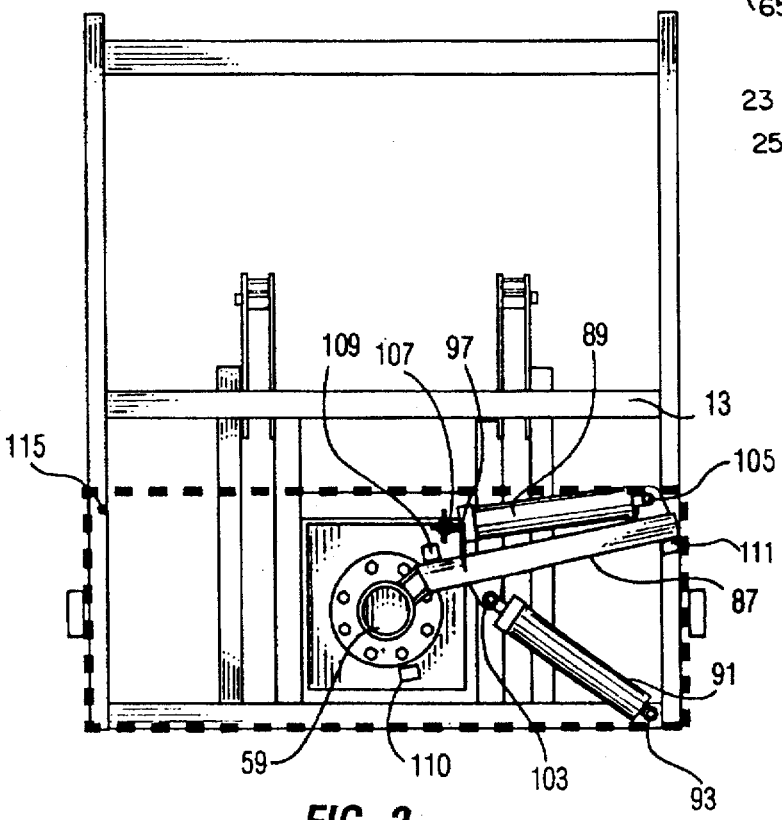
FIG. 2 is a simplified schematic view of the fixed frame and support frame of the apparatus of the invention with the support frame being shown in bold dotted lines in the initial, horizontal position.
Figure 4:
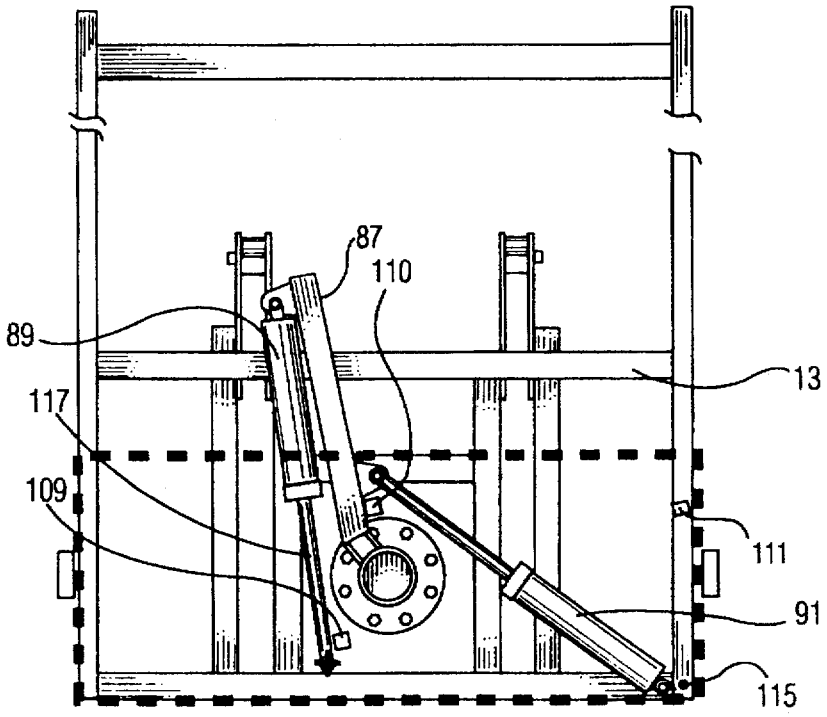
FIG. 4 is a view similar to FIG. 3 but showing the continued angular rotation of the support frame approximately 180° from the initial position to the full dumping position upon actuation of the secondary rotator cylinder.

As shown in FIG. 5, the fixed frame 13 is provided with rotator means for rotating the support frame 35 approximately 180° through a selected range of angular rotation between a horizontal position shown in FIG. 2 and a dumping position, shown in FIG. 4, at any of a plurality of selected vertically elevated positions of the lifting attachment. As will be explained with reference to FIG. 5, the rotator means preferably includes a piston actuated rotator assembly which is independent of the lifting attachment for rotating the support frame 35. The piston actuated rotator assembly includes a plurality of rotator pistons, each of which is capable of rotating the support frame through a discrete portion of the selected range of angular rotation.

As shown in FIG. 5, the rotator shaft 59 of the support frame 35 includes a bearing shaft 73 which is rotatably received within a sealed axle bearing assembly, designated generally as 75 in FIG. 5. The axle bearing shaft 73 is secured within the assembly by means of a nut 77 and end cap 79 which mount double row tapered thrust bearings 81 between an outer race 83 and bearing cup 85. A bearing assembly of the type shown is commercially available from a number of sources and is described, e.g., on page 232 of the 1995 W. W. Grainger, Inc. catalog under the heading "Precision Tapered Roller Bearings" as well as in the 1995 Machinist Handbook, page 611 as an American National Standard Thrust Ball and Roller Bearing Assembly.

As shown in FIG. 2, the piston actuated rotator assembly includes a rotator arm 87 which is connected to the support frame. A secondary rotator piston 89 is connected between the support frame 35 at a mounting point 107 and the rotator arm 87. A primary rotator piston 91 is connected between the rotator arm 87 and a connection point 93 on the fixed frame 13 for moving the refuse container between the horizontal position and the dumping position.

As shown in FIG. 5, the shaft 59 of the axle bearing assembly extends outwardly from the vertical wall portion 29 generally normal thereto and is fixedly mounted to the support plate 57 leaving an exposed length 95 of the shaft between the vertical wall portion 27 of the fixed frame 13 and the support plate 57 of the support frame 35. The rotator arm 87 is attached to the exposed length 95 of the rotatable shaft 59 at one extent 97 thereof. In the embodiment shown, the outer extent 97 includes a bolt-on end coupling 99 and internal bushing 101.

As best seen in FIG. 2, the primary rotator piston 91 is attached to the rotator arm 87 at a proximate point 103 adjacent the rotatable shaft 59. The secondary rotator piston 89 is attached to the rotator arm 87 at a distant point 105 at an opposite extent thereof. The primary rotator piston 91 has a cylinder body which is fixedly mounted to the fixed frame at the point 93 and has an output shaft which is attached to the rotator arm 87 at the proximate point 103. The secondary rotator piston 89 has a cylinder body which is mounted to the rotator arm at the distant point 105 and has an output shaft which is connected to the support frame at a mounting point 107. The primary and secondary rotator pistons 87, 89 are both arranged in a common plane which defines a spaced-apart opening ("o" in FIG. 5) between the exterior surface 29 of the vertical wall portion of the fixed frame 13 and the support plate 57 of the support frame 35. As shown in FIGS. 2 and 5, the fixed frame 13 has a stationary stop lug 111 fixedly mounted thereon. Stop lugs 109, 110 rotate with the support frame 35 as the primary and secondary rotator pistons 87, 89 are sequentially actuated.

The operation of the lifting and dumping apparatus of the invention will now be described. The apparatus can be used to lift and dump a container, such as container 69, by first engaging the fork arms 63, 65 within the container side channels 71. The lifting attachment 15 can then be actuated, causing piston rods 21, 23, 25 to extend from their respective cylinders to raise the lifting attachment from the rest position on the ground to the vertically elevated position shown in FIG. 1. The lifting attachment 15 can thus be used to transport the container 69 to another location or to place the container on the back of a truck or other conveyance means.

Figure 3:
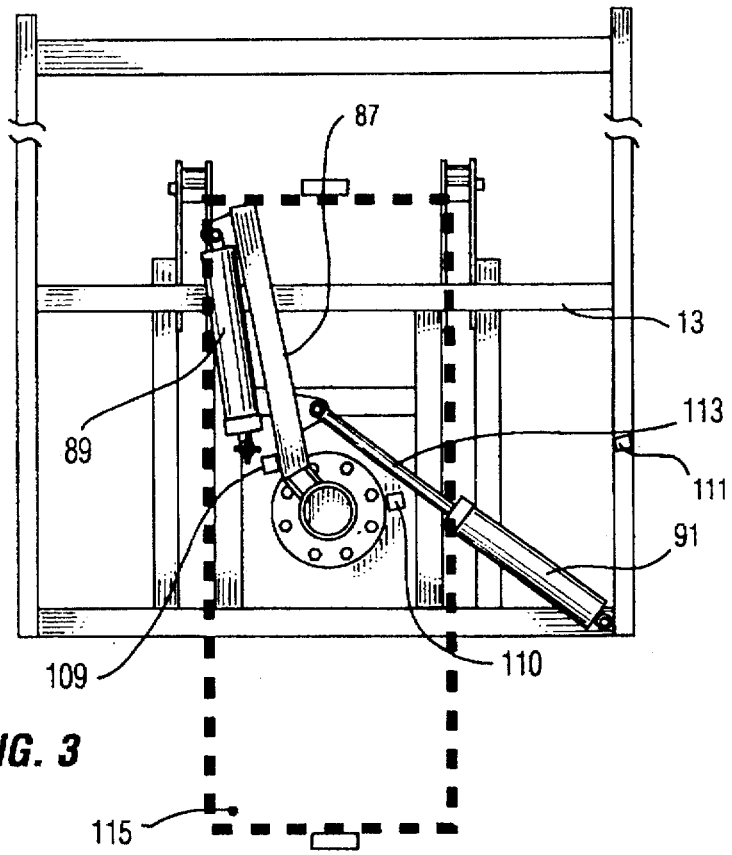
FIG. 3 is a view similar to FIG. 2 showing the first stage in the angular rotation of the support frame upon actuation of the primary rotator cylinder.

To dump the container 69, the primary rotator piston 91 (FIG. 2) is hydraulically actuated, causing the output shaft 113 (FIG. 3) to be extended from the position shown in FIG. 2 to the position shown in FIG. 3. Note the movement of the reference point 115 from FIGS. 2 to 3 as the container (shown in bold dotted lines) is moved from the horizontal position of FIG. 2 to an approximate 90° intermediate position shown in FIG. 3. Note also that the stop lug 109 rests against the upper surface of the rotator arm 87.

The secondary rotator piston 89 is then hydraulically actuated causing the output shaft 117 (FIG. 4) to extend to move the container approximately 180° from the horizontal until the stop lug 110 on the support frame contacts support arm 87 and the output shaft 117 is fully extended. The container can be returned to the full horizontal position by the reverse hydraulic actuation of the secondary and primary rotator pistons 89, 91, respectively.

An invention has been provided with several advantages. The apparatus of the invention can be used to lift a refuse container for relocation or transport. The apparatus can also be used to rotate a refuse container for dumping. The apparatus can be used to lift and rotate a container for welding and other repair or maintenance operations. The rotator means, utilizing a plurality of rotator pistons and a rotator arm, is simple in design and economical to manufacture and is extremely strong and reliable in operation.

While the invention has been shown in only one of its forms, it is not thus limited but is susceptible to various changes and modifications without departing from the spirit thereof.

What is claimed is:

1. A lifting and dumping apparatus for dumping the contents of a refuse container, the container having a pair of longitudinally extending side channels, the lifting and dumping apparatus comprising:

a fixed frame connected to a lifting attachment for moving the fixed frame between a rest position and a vertically elevated position and including a rotatable shaft;

a support frame rotatably mounted about the rotable shaft of the fixed frame, the support frame having a pair of fork arms for engaging the container side channels;

a piston actuated rotator assembly independent of the lifting attachment for rotating the support frame, and hence the refuse container, approximately 180 degrees between a horizontal position and a dumping position at any of a plurality of selected vertically elevated positions of the lifting attachment;

wherein the piston actuated rotator assembly includes a rotator arm connected to the support frame, a secondary rotator piston connected between the support frame and the rotator arm and a primary rotator piston connected between the rotator arm and the fixed frame for moving the refuse container between the horizontal position and the dumping position; and wherein the rotator arm is attached to an exposed length of the rotatable shaft by a fixed attachment point at one extent thereof, the primary rotator piston being attached to the rotator arm at a proximate point adjacent the rotatable shaft and the secondary rotator piston being attached to the rotator arm at a distant point at an opposite extent thereof.

2. A lifting and dumping apparatus for dumping the contents of a refuse container, the container having a pair of longitudinally extending side channels, the lifting and dumping apparatus comprising:

a fixed frame connected to a lifting attachment for moving the fixed frame between a rest position and a vertically elevated position;

a support frame rotatably mounted on the fixed frame, the support frame having a pair of fork arms for engaging the container side channels;

a piston actuated rotator assembly independent of the lifting attachment for rotating the support frame, and hence the refuse container, approximately 180 degrees between a horizontal position and a dumping position at any of a plurality of selected vertically elevated positions of the lifting attachment;

wherein the piston actuated rotator assembly includes a rotator arm connected to the support frame, a secondary rotator piston connected between the support frame and the rotator arm and a primary rotator piston connected between the rotator arm and the fixed frame for moving the refuse container between the horizontal position and the dumping position; and wherein the fixed frame has a vertical wall portion with an exterior surface and an interior surface, the vertical wall portion being provided with an axle bearing assembly including a rotatable shaft which extends between the vertical wall exterior surface and the support frame, whereby the support frame is rotatable about the rotatable shaft between the horizontal and dumping positions.

3. The lifting and dumping apparatus of claim 2, wherein the support frame has a top, bottom and opposing sides which enclose a support plate, the shaft of the axle bearing assembly extending outwardly from the vertical wall portion generally normal thereto and being fixedly mounted to the support plate leaving an exposed length of the shaft between the vertical wall portion of the fixed frame and the support plate of the support frame.

4. The lifting and dumping apparatus of claim 3, wherein the rotator arm is attached to the exposed length of the rotatable shaft at one extent thereof, the primary rotator piston being attached to the rotator arm at a proximate point adjacent the rotatable shaft and the secondary rotator piston being attached to the rotator arm at a distant point at an opposite extent thereof.

5. The lifting and dumping apparatus of claim 4, wherein the primary rotator piston has a cylinder body fixedly mounted to the fixed frame and an output shaft which is attached to the rotator arm proximate point and wherein the secondary rotator piston has a cylinder body which is mounted to the rotator arm distant point and an output shaft which is connected to the support frame.

6. The lifting and dumping apparatus of claim 5, wherein the primary and secondary rotator pistons are both arranged in a common plane which defines a spaced-apart opening between the exterior surface of the vertical wall portion of the fixed frame and the support plate of the support frame.

* * * * *